US010948160B2

(12) United States Patent
He et al.

(10) Patent No.: US 10,948,160 B2
(45) Date of Patent: Mar. 16, 2021

(54) FREEZER ILLUMINATION LENS SYSTEM

(71) Applicants: Self Electronics Co., Ltd., Zhejiang (CN); Wanjiong Lin, Zhejiang (CN); Self electronics USA Corporation, Norcross, GA (US)

(72) Inventors: Zuping He, Zhejiang (CN); Yuanfang Xue, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/725,548

(22) Filed: Dec. 23, 2019

(65) Prior Publication Data

US 2020/0200360 A1 Jun. 25, 2020

(30) Foreign Application Priority Data

Dec. 25, 2018 (CN) ..... 201811596910.5

(51) Int. Cl.

| | |
|---|---|
| ***F21V 13/00*** | (2006.01) |
| ***F21V 5/04*** | (2006.01) |
| ***F21V 19/00*** | (2006.01) |
| ***F25D 27/00*** | (2006.01) |
| *F21Y 115/10* | (2016.01) |
| *F21W 131/305* | (2006.01) |

(52) U.S. Cl.

CPC ..... *F21V 5/04* (2013.01); *F21V 19/0045* (2013.01); *F25D 27/00* (2013.01); *F21W 2131/305* (2013.01); *F21Y 2115/10* (2016.08)

(58) Field of Classification Search

CPC ..... F21W 2131/305; F21W 2131/405; F21S 4/28

See application file for complete search history.

(56) References Cited

U.S. PATENT DOCUMENTS

| | | | | |
|---|---|---|---|---|
| 5,895,111 | A * | 4/1999 | Santosuosso | A47F 3/001 362/125 |
| 8,115,411 | B2 * | 2/2012 | Shan | G09F 13/22 315/294 |
| 8,235,539 | B2 * | 8/2012 | Thomas | F21V 15/013 362/92 |
| 8,791,650 | B2 * | 7/2014 | Shan | F21S 4/28 315/294 |
| 8,985,795 | B2 * | 3/2015 | Thomas | F21V 21/00 362/92 |

(Continued)

*Primary Examiner* — Andrew J Coughlin

(74) *Attorney, Agent, or Firm* — Wang Law Firm, Inc.

(57) ABSTRACT

The invention relates to a freezer illumination lens system, comprising a lighting fixture, a lens connected with the lighting fixture and a mounting groove configured for receiving a printed circuit board supporting a LED light source by insertion. The lens comprises a light transmitting main portion, a first light transmitting auxiliary portion and a second light transmitting auxiliary portion. The light transmitting main portion is configured and arranged relative to the LED light source such that a major portion of light emitted by the LED light source is focused, and the first light transmitting auxiliary portion and the second light transmitting auxiliary portion are arranged along long sides of the light transmitting main portion. The invention has the advantages that the utilization rate of light can be improved, the illumination can be uniform, and the overall illumination effect can be improved.

12 Claims, 3 Drawing Sheets

(56) References Cited

U.S. PATENT DOCUMENTS

| | | | | |
|---|---|---|---|---|
| 9,157,675 | B2 * | 10/2015 | Howington | F25D 27/00 |
| 9,456,704 | B2 * | 10/2016 | Bhargava | F21V 7/0025 |
| 2005/0265019 | A1 * | 12/2005 | Sommers | F21S 4/20 362/217.16 |
| 2011/0058357 | A1 * | 3/2011 | Anderson | A47F 3/001 362/125 |
| 2014/0126197 | A1 * | 5/2014 | Dixon | F21L 4/00 362/218 |
| 2015/0208827 | A1 * | 7/2015 | Twohy | F25D 27/00 62/3.6 |
| 2016/0377257 | A1 * | 12/2016 | Xu | F21V 5/08 362/224 |
| 2016/0377258 | A1 * | 12/2016 | Xu | F21V 5/04 362/223 |
| 2017/0370539 | A1 * | 12/2017 | Xu | F21V 5/08 |

* cited by examiner

FREEZER ILLUMINATION LENS SYSTEM

RELATED APPLICATION

This application claims priority to a Chinese Patent Application No. CN 201811596910.5, filed on Dec. 25, 2018.

FIELD OF THE TECHNOLOGY

The invention relates to the field of optics, in particular to a illumination lens system for an ice cabinet or freezer.

BACKGROUND OF THE INVENTION

Because of the advantages of low voltage, high light efficiency, pure color and no impurity, LED lamps are widely used in the field of home appliances such as freezers.

As an example, Chinese utility model CN 207778135U with the title 'Light distribution system for freezers' discloses a light distribution system comprising a strip-shaped LED lamp to be arranged on the freezer door. The strip-shaped LED lamp includes a lamp holder, an imaging lens and an LED chip. Both ends of the imaging lens are provided with a mounting portion. Corresponding grooves are provided at corresponding positions of the lamp holder, and the imaging lens is fixed by inserting the mounting portions into the associated grooves.

Although the light distribution system solves the problem of lighting the freezer well, the mounting structure for mounting the lens at the lighting fixture causes that the walls of the grooves block a certain part of the light emitted by the LED, resulting in the embarrassing situation that even if the LED light-emitting angle is 180°, the effective LED light-emitting angle is only 120°, resulting in low light utilization. Even if the mounting structure also has the function of light transmission, it is still useless.

BRIEF SUMMARY OF THE INVENTION

It is an object of the present invention to provide an enhanced freezer illumination lens system for freezers that enables a more efficient light utilization and can be produced and mounted easily at low costs.

According to the present invention there is provided a freezer illumination lens system for freezers, comprising a lighting fixture, a lens connected with the lighting fixture and a mounting groove configured for receiving a printed circuit board (PCB) supporting a LED light source by insertion. The lens comprises a light transmitting main portion, a first light transmitting auxiliary portion and a second light transmitting auxiliary portion. The light transmitting main portion is configured and arranged relative to the LED light source such that a major portion of light emitted by the LED light source is focused when the PCB is received in the mounting groove. The first light transmitting auxiliary portion and the second light transmitting auxiliary portion are arranged along long sides of the light transmitting main portion and include an angle with each other, for guiding a minor portion of the light emitted by the LED light source.

According to the present invention a lower end face of the first light transmitting auxiliary portion is integrally formed with the lighting fixture for connecting the lens and the lighting fixture, wherein the mounting groove is formed between the lower end face of the first light transmitting auxiliary portion and the lighting fixture, so that light emitted by the LED light source can freely pass the lens without being blocked.

According to a further embodiment, the light transmitting main portion may be configured and arranged relative to the LED light source such that the major portion of the light emitted by the LED light source is focused and projected toward the far end of an illuminating surface.

According to a further embodiment, the second light transmitting auxiliary portion may be configured and arranged relative to the LED light source such that the minor portion of the light emitted by the LED light source is focused and projected toward the near end of the illuminating surface.

According to a further embodiment, if viewed in a cross-section, the radius of curvature of a light exit surface of the light transmitting main portion, starting from the first light transmitting auxiliary portion and towards the second light transmitting auxiliary portion, first reduces and then increases so that the major portion of the light emitted by the LED light source is focused and projected towards the far end of the illuminating surface.

According to a further embodiment, if viewed in a cross-section, the radius of curvature of a light exit surface of the second light transmitting auxiliary portion may increase gradually, and the minimum radius of curvature of the light exit surface of the second light transmitting auxiliary portion may be larger than the maximum radius of curvature of the light exit surface of the light transmitting main portion, so as to guide the minor portion of the light emitted by the LED light source toward the near end of the illuminating surface.

According to a further embodiment, the light exit surface of the light transmitting main portion and the light exit surface of the second light transmitting auxiliary portion may be connected by a transition surface having a varying radius of curvature, which is first negative and then changes to be positive, wherein the radius of curvature of the transition surface is in a range between the maximum radius of curvature of the light exit surface of the light transmitting main portion and the minimum radius of curvature of the light exit surface of the second light transmitting auxiliary portion.

According to a further embodiment, the radius of curvature of the transition surface may be positive at a joint of the light incident surface of the light transmitting main portion and the light incident surface of the second light transmitting auxiliary portion.

According to a further embodiment, the light incident surface of the second light transmitting auxiliary portion and the light exit surface of the second light transmitting auxiliary portion may be configured such that the minor portion of light emitted by the LED light source is projected vertically toward the near end of the illuminating surface by the second light transmitting auxiliary portion.

According to a further embodiment, the light exit surface of the first light transmitting auxiliary portion may be planar and the light exit surface of the light transmitting main portion may be connected with the light exit surface of the first light transmitting auxiliary portion via a planar transition surface.

According to a further embodiment, the light incident surface of the light transmitting main portion and the light incident surface of the light transmitting auxiliary portions may be planar, and the light incident surface of the light transmitting main portion may be parallel to the PCB when received in the mounting groove.

According to a further embodiment, the lens comprises two lenses, wherein the second light transmitting auxiliary portion of the first lens is preferably integrally connected with the second light transmitting auxiliary portion of the second lens, the lighting fixture is preferably integrally connected with the lower end surface of the first light transmitting auxiliary portion of the first lens and the lower end surface of the first light transmitting auxiliary portion of the second lens, and the light incident surface of first light transmitting main portion of the first lens is preferably arranged opposite to the light incident surface of the light transmitting main portion of the second lens.

According to a further embodiment, the first lens and the second lens may be arranged mirror symmetrically with respect to a central axis of the lighting fixture.

According to a further embodiment, the light incident surface the light transmitting main portion of the first lens and the light incident surface of the light transmitting main portion of the second lens may enclose an acute angle, and the illuminating surface may be perpendicular to the plane in which the acute angle is enclosed.

According to a further embodiment, the PCB supporting the LED light source is received in the mounting groove.

Compared with the prior art as outlined above, where the lens was embedded in the lamp bracket groove through the lens mounting part for fixation and the groove wall of the groove body usually blocked the structure of the light cast to the mounting part, a freezer illumination lens system for freezers according to the present invention offers in particular the following advantages: The lens is improved to have the light transmitting main portion and the light transmitting auxiliary portion, because the lower end face of the first light transmitting auxiliary portion is integrally formed with the lighting fixture for connecting the lens and the lighting fixture and the mounting groove is formed between the lower end face of the first light transmitting auxiliary portion and the lighting fixture. Therefore, light emitted by the LED light source can freely pass the lens without being blocked. At the connection of the frame, such changes make the light in the 180 degree light-emitting area of the LED light source can freely pass the light transmitting main portion and the light transmitting auxiliary portion without being blocked, so as to improve the light utilization rate. The existence of the transition surface can well alleviate the uneven brightness caused by the light from the second auxiliary portion of the light transmission due to the low brightness and the multi brightness of the light from the main part of the light transmission, so as to ensure the anti glare The design of multiple lenses can achieve multi angle illumination and improve the overall illumination effect.

DETAILED DESCRIPTION OF THE INVENTION

Embodiments of the invention will be described in detail below, examples of which are shown in the accompanying drawings, in which the same or similar reference signs designate the same or similar elements or elements with the same or similar function. The embodiments described below with reference to the accompanying drawings are exemplary and only serve for a better understanding of the invention but should not be construed to delimit the present invention.

Figure 1:
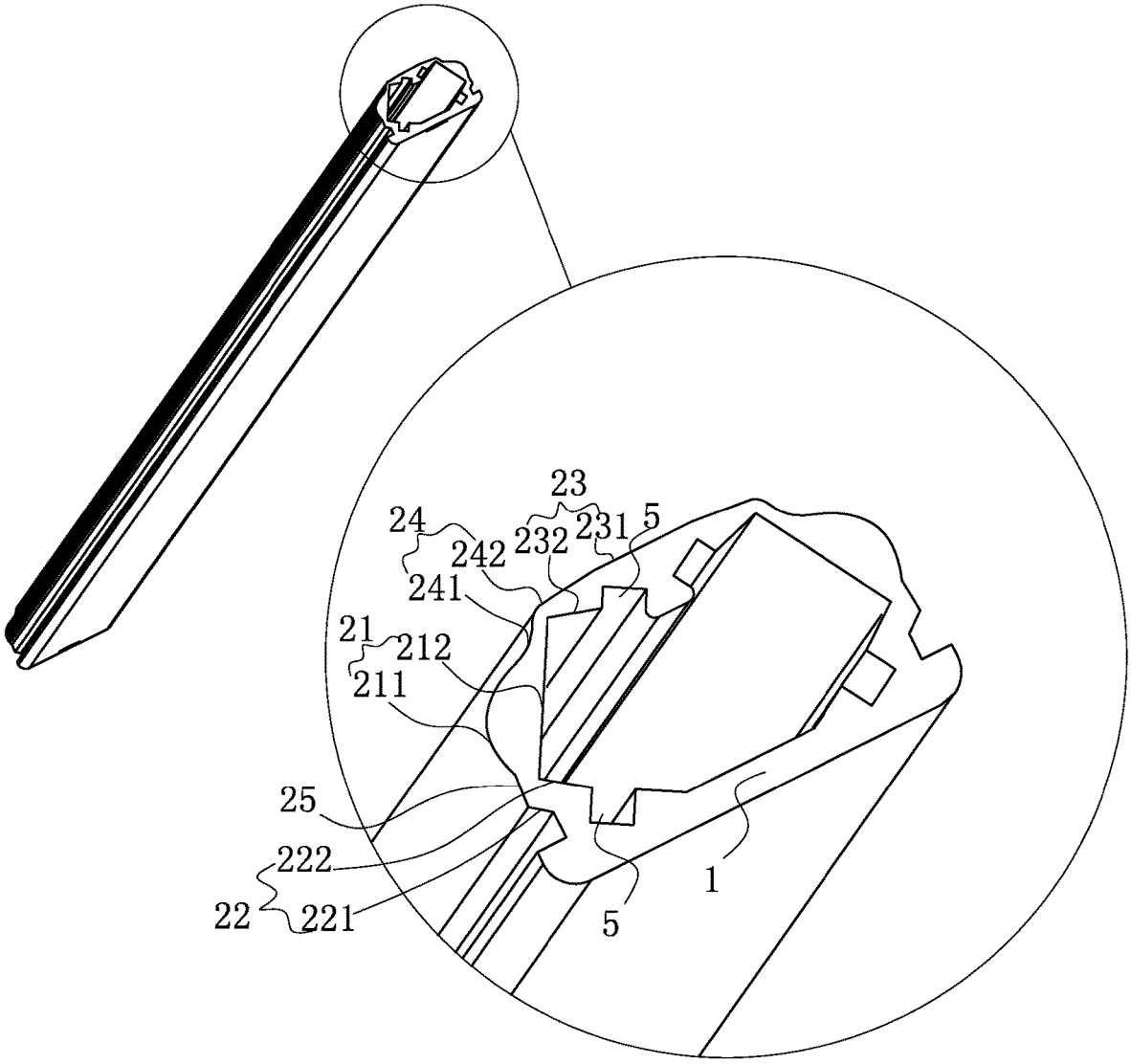
FIG. 1 shows the general structural of the freezer illumination lens system for freezers according to the present invention.
Figure 2:
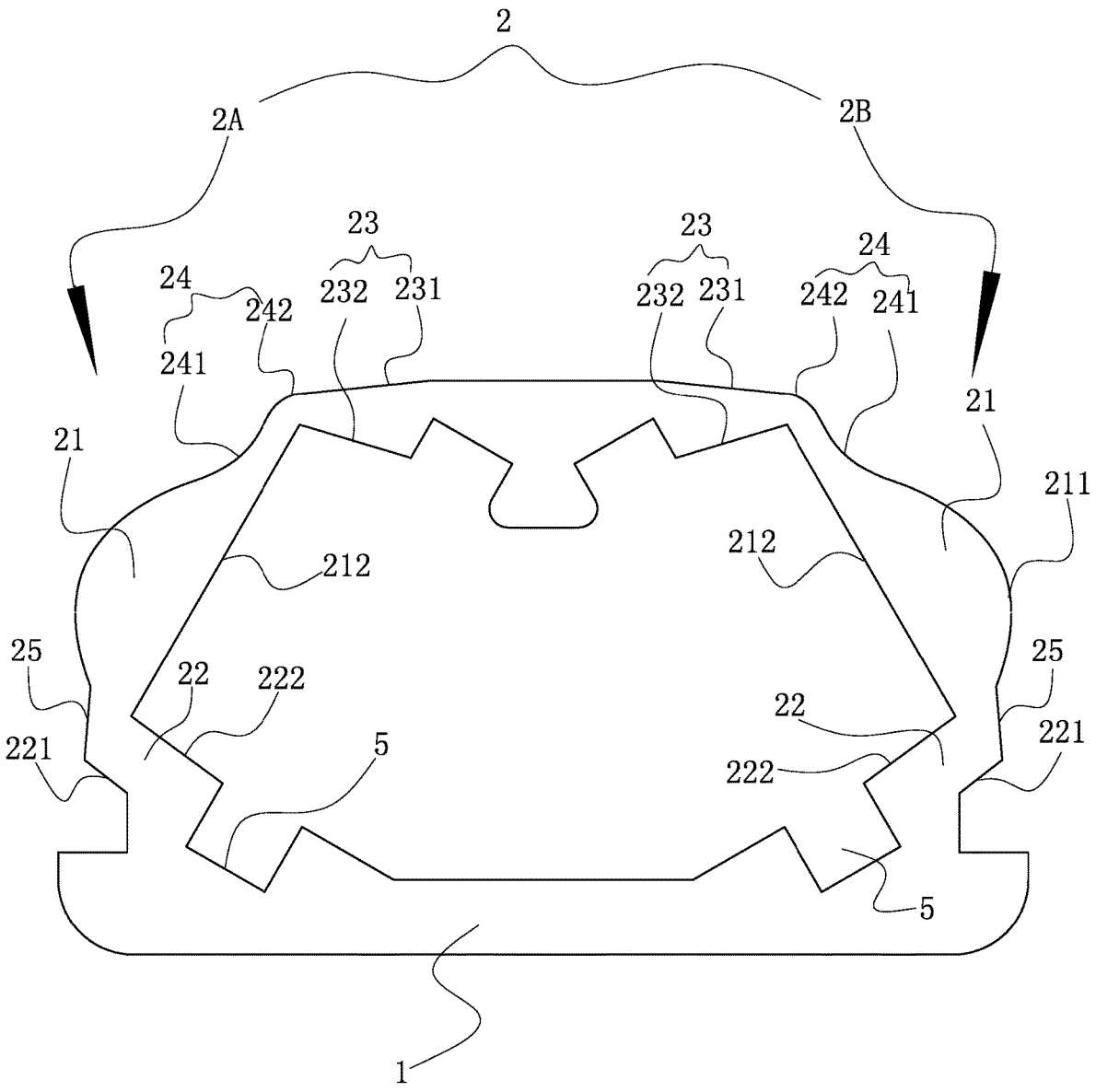
FIG. 2 is a cross-sectional view of the lens shown in FIG. 1
Figure 3:
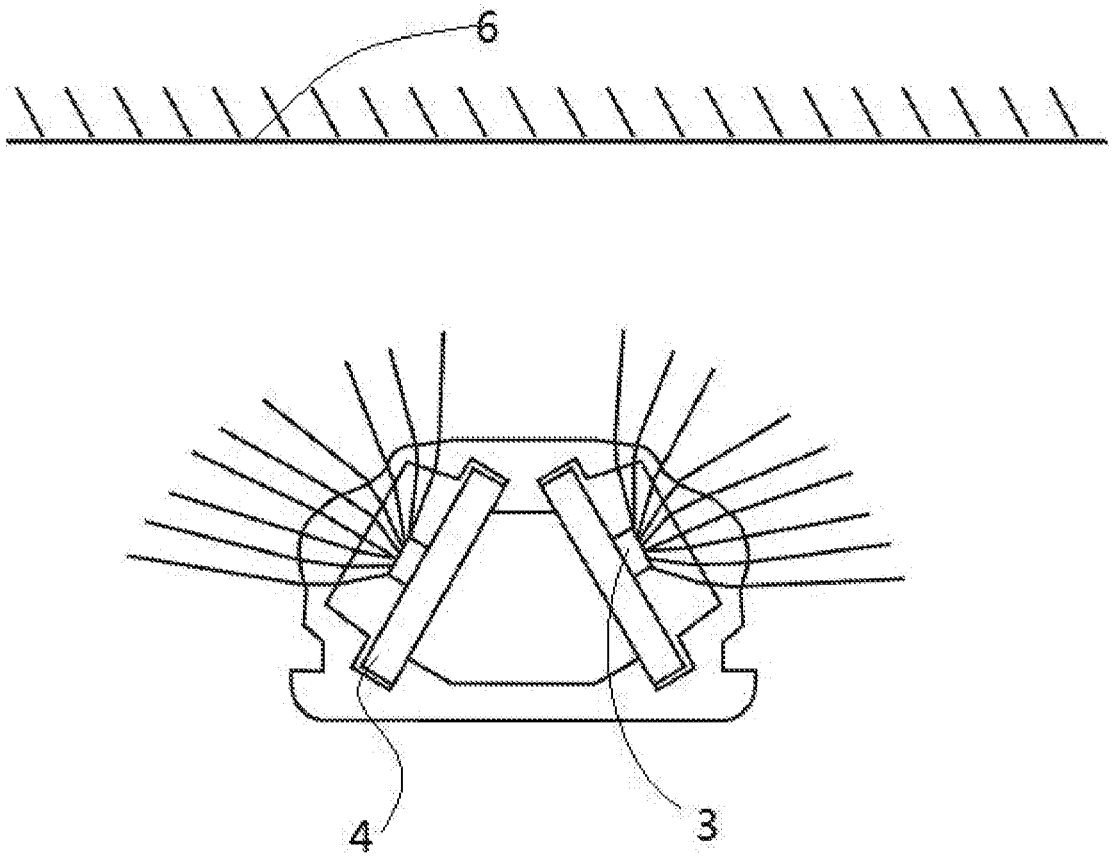
FIG. 3 is a diagram showing the optical path of the freezer illumination lens system for freezers according to the present invention.

For an introductory explanation, FIGS. 1-3 show an embodiment of a freezer illumination lens system for freezers according to the present application. As we all known, a freezer includes not only a lens system for lighting, but also other components such as a cabinet door and condenser. However, since these components are not the subject-matter of the present application, they are not described in detail here.

The freezer illumination lens system for freezers generally comprises a lighting fixture 1 and a lens 2 connected with the lighting fixture 1. The lens 2 is a lens that deflects light with respect to the optical axis of the light source, i.e. has an asymmetrical design. This kind of special-shaped lens is designed by the manufacturer according to the user's requirements for interior lighting of the freezer. Compared with the conventional symmetrical design, it can better meet the lighting requirements. The lens 2 according to the present invention comprises a light transmitting main portion 21 which serves to focus the central major portion (central part of the beam coil) of light emitted by the LED light source 3, a first light transmitting auxiliary portion 22 and a second light transmitting auxiliary portion 23 which are arranged along the long side of the light transmitting main portion 21 and which together include a small acute angle for guiding the lateral minor portion of the light emitted by the LED light source 3.

In order to overcome the problem of a conventional lens that the mounting structures need to be inserted into a groove of the lighting fixture and that the walls of this groove block light directed to the mounting structure, resulting in a low light utilization rate, the lower end surfaces of the light transmitting auxiliary portions 22 and 23 are integrally formed with the lighting fixture 1 and made of transmissive material, so as to implement an integral connection of the lens 2 and the lighting fixture 1. At the same time, a mounting groove 5 is formed at the connection or transition region between the lower end surfaces of the light transmitting auxiliary portions 22 and 23 and the lighting fixture 1 to receive therein the side-edges of a printed circuit board (PCB) 4 supporting a LED light source 3 serving as a light source for lighting. The LED light source 3 generally is mounted onto the PCB 4 such that the light is emitted basically perpendicular to the planar surface of the PCB 4. In this way, when the PCB 4 is mounted or received in the groove 5, because of the integral design, the conventional mounting structure and the groove body are omitted. Thus, according to the present invention even the light of the LED light source 3 emitted under a light-emitting angle of 180 degrees, especially the minor portions (lateral parts of the beam coil emitted by the LED light source) of light emitted toward side-edges of the LED light source 3, can freely pass the lens, and at the same time, with the first auxiliary lens portion and the second auxiliary lens portion, the light emitted toward the outer edge of the LED light source 3 can be well projected, that is, the light emitted toward the outer edge of the LED light source 3 (lateral part of the beam coil emitted by the LED light source), which is blocked by the groove wall in the conventional light distribution system outlined above, can be utilized as well for lighting the interior of the freezer, which assists in improving light utilization.

Because the light that passes the light transmitting auxiliary portions of the lens mainly comes from the outer edge of the LED light source or mainly is emitted toward the outer edge of the LED light source (minor portion of light emitted), and because the light that passes the light transmitting main portion of the lens and represents the major portion of the light emitted by the LED light source comes from the central portion of the light source (central beam coil), it is obvious that the light passing the auxiliary portions of the lens is relatively weak, whereas the light passing the main portion of the lens is relative bright. Conventionally, this was likely to cause poor brightness, causing user discomfort. In order to avoid this problem, by improving the transparency of the lens 2 according to the present invention, the light passing the light transmitting main portion 21 and the light passing the second light transmitting auxiliary portion 23 can both be used to irradiate the far end of the illuminating surface 6 in the freezer (not shown), and the light passing the second light transmitting auxiliary portion 23 can be used to irradiate the near end of the illuminating surface 6 in the freezer.

In this way, according to the principle of light propagation and energy attenuation, the energy of distant light will be greatly attenuated in operation, and the light will be correspondingly weakened when it finally reaches the far end, so that the light formed at the far end is basically the same as the light formed at the near end, without brightness difference.

Based on the principles of light attenuation during propagation of light, in order to ensure that the light propagating to the far end will not be attenuated too much and that the brightness at the far end is basically the same as that at the near end, according to the present invention the profile of the light transmitting main portion 21 is not a symmetric profile, as can be concluded from FIG. 2. More specifically, the radius of radius of curvature of the light exit surface 211 of the light transmitting main portion 21 is larger near the first light transmitting auxiliary portion 22 and gradually decreases towards the second light transmitting auxiliary portion 23. Thus, a major portion of the light from the LED light source is focused and then projected to the far end of the illuminating surface 6.

Accordingly, the radius of curvature of the light exit surface 231 of the second light transmitting auxiliary portion 23 is designed to gradually increase. However, the minimum radius of curvature of the light exit surface 231 of the second light transmitting auxiliary portion 23 is larger than the maximum radius of curvature of the light exit surface 211 of the light transmitting main portion 21, as shown in FIG. 2. Thus, a minor portion of the light emitted by the LED light source (mainly emitted toward the outer edge of the LED light source) can be guided towards the near end of the illuminating surface 6, so as to reduce the energy attenuation compared to convention light distribution systems. According to the principles of optics, if the radius of curvature of a lens and light intensity is small, the ability to image and focus is strong, and the imaged light distribution can be relatively uniform, so that the problem of brightness consistency can be well controlled.

Obviously, the larger the radius of curvature of the second light transmitting auxiliary portion 23 is, the closer the corresponding light exit surface of the second light transmitting auxiliary portion 23 is to the near end of the illuminating surface 6, as will be obvious to the skilled person, so this effect will not be explained in detail here. At the same time, it should be mentioned that it is obvious that the illuminating surface 6 in this embodiment is located near the second light transmitting auxiliary portion 23. Of course, the first light transmitting auxiliary portion 22 may also be used as the near end lens for the illuminating surface 6 as required, but at this time, the adjustment of the installation position will also be corresponding, which is not the focus of the application, so it is not cumbersome.

At the same time, it should be noted that although controlling the variation of the radius of curvature of the light transmitting main portion 21 and of the second light transmitting auxiliary portion 23 can effectively ensure a uniform illumination, there may still be a large difference in the radius of curvature between the light transmitting main portion 21 and the second light transmitting auxiliary portion 23. In order to ensure a more uniform illumination, as an improvement, the light exit surface 211 of the light transmitting main portion 21 and the light exit surface 231 of the second light transmitting auxiliary portion 23 may be connected with each other via a transition surface 24, wherein the transition surface 24 first has a negative radius of curvature and then has a positive radius of curvature. The radius of curvature of the transition surface 24 thus may gradually vary as required and particularly may be in the range between the maximum radius of curvature of the light exit surface 211 of the light transmitting main portion 21 and the minimum radius of curvature of the light exit surface 231 of the second light transmitting auxiliary portion 23.

The amount of light received by and passing through the transition surface 241 close to the light transmitting main portion 21 is higher than the amount of light that is received by and passes through the transition surface 242 close to the second light transmitting auxiliary portion 23, so that most of the light near the second light transmitting auxiliary portion 23 comes from the outer edge of the light source. When the brightness of the light emitted is weak, and it is easy to perceive difference in brightness at the illuminating surface 6. According to the present invention, the transition surface 241 with varying negative radius of curvature that finally changes to a positive radius of curvature can cause the emitted light to diverge and well reconcile. The transition surface 242 thus can ensure a proper brightness of the light emitted and a good uniformity of the illumination at the illuminating surface 6. Further details of light propagation and imaging of light emitted by the LED light source are schematically shown in FIG. 3.

In this embodiment, the radius of curvature of the transition surface 24 is positive and has a turning point at the position where the light incident surface 212 of the light transmitting main portion 21 and the light incident surface 232 of the second light transmitting auxiliary portion 23 intersect, because the LED light source is positioned in such a manner that the central beam coil emitted by the LED light source extends towards just about this position, as can be concluded from FIG. 3. Thus, the change of the positive radius of curvature can further assist in focusing the light properly, thus further ensuring the uniformity of the light after imaging.

In a preferred embodiment of the present embodiment, the light incident surface 232 and the light exit surface 231 of the second light transmitting auxiliary portion 23 are matched such that the minor portion of the light emitted by the LED light source 3 is projected by the second light transmitting auxiliary portion 23 vertically toward the near end of the illuminating surface 6, so as to meet the lighting requirements of different users.

Referring to FIG. 1 and FIG. 2, according to the present invention it may be preferred that the light exit surface 221 of the first light transmitting auxiliary portion 22 is planar and that the light exit surface 211 of the light transmitting main portion 21 is connected with the light exit surface 221 of the first light transmitting auxiliary portion 22 via a planar transition surface 25. The light incident surface 212 of the light transmitting main portion 21 and the light incident surfaces 222 and 232 of the light transmitting auxiliary portions 22 and 23 may all be planar, and the planar light incident surface 212 of the light transmitting main portion 21 is preferably parallel to the PCB 4 when mounted or received in the groove 5.

According to different requirements, the freezer illumination lens system for freezers according to the present invention may comprise a plurality of lenses of the kind, as shown in FIG. 1 and FIG. 2, e.g. it may comprise two such lighting lenses 2A and 2B, wherein the second light transmitting auxiliary portion 23 of the first lighting lens 2A is integrally formed and connected with the second light transmitting auxiliary portion 23 of the second lighting lens 2B, and wherein the lighting fixture 1 and the lower end surfaces of the first light transmitting auxiliary portion 22 of the first lighting lens 2A and of the first light transmitting auxiliary portion 22 of the second lighting lens 2B are respectively integrally formed, and wherein the light incident surface 212 of the light transmitting main portion 21 of the first lighting lens 2A is arranged opposite to the light incident surface 212 of the light transmitting main portion 21 of the second lighting lens 2B.

In order to ensure a symmetric distribution of the imaged light and prevent glare, the first lighting lens 2A and the second lighting lens 2B are arranged in mirror symmetrical arrangement with respect to the central axis of the lighting fixture 1. Since the second light transmitting auxiliary portion 23 is directed towards the illuminating surface 6, the light incident surface 212 of the light transmitting main portion 21 of the first lighting lens 2A is set at an acute angle relative to the light incident surface 212 of the light transmitting main portion 21 of the second lighting lens 2B, and the illuminating surface 6 is perpendicular to a plane in which this acute angle is included. Thus, by choosing a design with multiple lighting lenses, one can achieve a multi angle illumination and improve the overall lighting effect.

In addition to the above improvements, other similar improvements are also included in the improvement scope of the invention, and will not be described here. Although embodiments of the present invention have been shown and described, it will be understood by those skilled in the art that various changes, modifications, substitutions and deformations can be made to these embodiments without departing from the principles and purposes of the present invention.

What is claimed is:

1. A freezer illumination lens system for freezers, comprising a lighting fixture (1), a lens (2) connected with the lighting fixture (1) and a mounting groove (5) configured for receiving a printed circuit board (PCB; 4) supporting a LED light source (3) by insertion, wherein the lens (2) comprises a light transmitting main portion (21), a first light transmitting auxiliary portion (22) and a second light transmitting auxiliary portion (23), wherein the light transmitting main portion (21) has an asymmetric light exit surface (211) between a transition surface (24) and a planar transition surface (25), and the asymmetric light exit surface (211) has greater concavity on an outer surface adjacent to the planar transition surface (25) than on an outer surface adjacent to the transition surface (24), the light transmitting main portion (21) is configured and arranged relative to the LED light source (3) such that a major portion of light emitted by the LED light source (3) is focused when the PCB is received in the mounting groove (5), and the first light transmitting auxiliary portion (22) and the second light transmitting auxiliary portion (23) are arranged along long sides of the light transmitting main portion (21) and include an angle with each other, for guiding a minor portion of the light emitted by the LED light source (3);

a lower end face of the first light transmitting auxiliary portion (22) is integrally formed with the lighting fixture (1) for connecting the lens (2) and the lighting fixture (1) and that the mounting groove (5) is formed between the lower end face of the first light transmitting auxiliary portion (22) and the lighting fixture (1), so that light emitted by the LED light source (3) can freely pass the lens (2) without being blocked; and the transition surface (24) having a varying radius of curvature, which is first negative and then changes to be positive, wherein the radius of curvature of the transition surface (24) is in a range between the maximum radius of curvature of the light exit surface (211) of the light transmitting main portion (21) and the minimum radius of curvature of the light exit surface (231) of the second light transmitting auxiliary portion (23).

2. The freezer illumination lens system for freezers according to claim 1, wherein the light transmitting main portion (21) is configured and arranged relative to the LED light source (3) such that the major portion of the light emitted by the LED light source (3) is focused and projected toward the far end of an illuminating surface (6), and the second light transmitting auxiliary portion (23) is configured and arranged relative to the LED light source (3) such that the minor portion of the light emitted by the LED light source (3) is focused and projected toward the near end of the illuminating surface (6).

3. The freezer illumination lens system for freezers according to claim 2, wherein the radius of curvature of a light exit surface (231) of the second light transmitting auxiliary portion (23) increases gradually, and the minimum radius of curvature of the light exit surface (231) of the second light transmitting auxiliary portion (23) is larger than the maximum radius of curvature of the light exit surface (211) of the light transmitting main portion (21), so as to guide the minor portion of the light emitted by the LED light source (3) toward the near end of the illuminating surface (6).

4. The freezer illumination lens system for freezers according to claim 2, wherein the light exit surface (211) of the light transmitting main portion (21) and the light exit surface (231) of the second light transmitting auxiliary portion (23) are connected by the transition surface (24).

5. The freezer illumination lens system for freezers according to claim 4, wherein the radius of curvature of the transition surface (24) is positive at a joint of the light incident surface (212) of the light transmitting main portion (21) and the light incident surface (232) of the second light transmitting auxiliary portion (23).

6. The freezer illumination lens system for freezers according to claim 2, wherein the light incident surface (232) of the second light transmitting auxiliary portion (23)

and the light exit surface (231) of the second light transmitting auxiliary portion (23) are configured such that the minor portion of light emitted by the LED light source (3) is projected vertically toward the near end of the illuminating surface (6) by the second light transmitting auxiliary portion (23).

7. The freezer illumination lens system for freezers according to claim 1, wherein the light exit surface (221) of the first light transmitting auxiliary portion (22) is planar and the light exit surface (211) of the light transmitting main portion (21) is connected with the light exit surface (221) of the first light transmitting auxiliary portion (22) via the planar transition surface (25).

8. The freezer illumination lens system for freezers according to claim 1, wherein the light incident surface (212) of the light transmitting main portion (21) and the light incident surface (222, 232) of the light transmitting auxiliary portions (22, 23) are planar, and the light incident surface (212) of the light transmitting main portion (21) is parallel to the PCB (4) when received in the mounting groove (5).

9. The freezer illumination lens system for freezers according to claim 1, wherein the lens (2) comprises two lenses (2A, 2B), wherein the second light transmitting auxiliary portion (23) of the first lens (2A) is integrally connected with the second light transmitting auxiliary portion (23) of the second lens (2B), the lighting fixture (1) is integrally connected with the lower end surface of the first light transmitting auxiliary portion (22) of the first lens (2A) and the lower end surface of the first light transmitting auxiliary portion (22) of the second lens (2B), and the light incident surface (212) of first light transmitting main portion (21) of the first lens (2A) is arranged opposite to the light incident surface (212) of the light transmitting main portion (21) of the second lens (26).

10. The freezer illumination lens system for freezers according to claim 9, wherein the first lens (2A) and the second lens (2B) are arranged mirror symmetrically with respect to a central axis of the lighting fixture (1).

11. The freezer illumination lens system for freezers according to claim 9, wherein the light incident surface (212) of the light transmitting main portion (21) of the first lens (2A) and the light incident surface (212) of the light transmitting main portion (21) of the second lens (2B) enclose an acute angle, and the illuminating surface (6) is perpendicular to the plane in which the acute angle is enclosed.

12. The freezer illumination lens system for freezers according to claim 1, wherein the PCB supporting the LED light source (3) is received in the mounting groove (5).

* * * * *